US006470525B1

(12) United States Patent
Silverman

(10) Patent No.: US 6,470,525 B1
(45) Date of Patent: Oct. 29, 2002

(54) DRAIN CLEANING APPARATUS HAVING REMOTE POWER FEED

(76) Inventor: Arthur A. Silverman, 2245 Harmain Rd., Pittsburgh, PA (US) 15235

( * ) Notice: Subject to any disclaimer, the term of this patent is extended or adjusted under 35 U.S.C. 154(b) by 0 days.

(21) Appl. No.: 09/451,163

(22) Filed: Nov. 30, 1999

(51) Int. Cl.[7] ..... B08B 9/02
(52) U.S. Cl. ..... 15/104.33
(58) Field of Search ..... 15/104.33, 104.31, 15/104.32; 226/143

(56) References Cited

U.S. PATENT DOCUMENTS

| | | | | | |
|---|---|---|---|---|---|
| 2,661,489 | A | * | 12/1953 | Rudolph et al. | 15/104.33 |
| 3,086,234 | A | * | 4/1963 | Crane | 15/104.33 |
| 3,268,937 | A | * | 8/1966 | Bollinger | 15/104.33 |
| 3,897,602 | A | * | 8/1975 | Waterbury | 15/104.33 |
| 4,956,889 | A | * | 9/1990 | Kirk | 15/104.33 |
| 5,901,401 | A | * | 5/1999 | Rutkowski et al. | 15/104.31 |
| 6,009,588 | A | * | 1/2000 | Rutkowski | 15/104.33 |

* cited by examiner

*Primary Examiner*—Gary K. Graham
(74) *Attorney, Agent, or Firm*—Metz Lewis LLC; Barry I. Friedman

(57) ABSTRACT

A drain cleaning apparatus comprises an auger for insertion into a drain pipe or conduit which is adapted to rupture or dislodge debris therein; a motorized drive for causing rotational motion of the auger, which motorized drive is associated with a receptacle for the storage and distribution of the auger therefrom; and a remote power feed device affixed to the motorized drive by a guide tube in which the auger is extended. The remote power feed selectively engages the external surface of the auger and translates the rotational movement of the auger caused by the motorized drive into lateral movement through the interaction of angularly mounted or threaded engagement means. A guide conduit is rotatably mounted within the guide tube, encircling the auger therein. The guide conduit is mounted to the rotatable auger containment receptacle and the motorized drive, but is freely rotatably displaced within the guide tube. The guide conduit is adapted to rotate in a synchronous fashion with the motorized drive, the rotatable auger containment receptacle and the auger itself. The guide conduit is further adapted to provide a reduction in the frictional interface between the auger and the inner surface of the guide tube. It terminates within the guide tube proximate to the remote power feed. The guide conduit may be constructed of any flexible material which is adapted to resist compression in the lateral or axial direction. It may be constructed of a flexible plastic tube, or, most preferably, a spring.

20 Claims, 5 Drawing Sheets

DRAIN CLEANING APPARATUS HAVING REMOTE POWER FEED

BACKGROUND OF THE INVENTION

1. Field of the Invention

The present invention relates to a drain cleaning apparatus of the type having a power feed device remote from the rotational, motorized auger source. More specifically, the invention relates to a drain cleaning device which utilizes an internal guide within the conduit connecting the remote power feed device and the motorized auger source to reduce binding and torsional stress on the auger cable.

2. Description of the Prior Art

A variety of drain cleaning devices are well known. In general, the construction of these devices comprises an auger, which is typically a helically constructed cable of sufficient resilience, lateral incompressibility and flexibility, to be inserted into a drain for dislodging debris which prevent fluid flow. The auger is introduced into the drain from a proximate opening and driven by force into the pipe or conduit which is clogged with debris. The auger may be provided with a blade or cutting mechanism at its inserted end to assist in the breakup of the debris. A rotational force is typically exerted on the auger to compound the force acting on the debris in combination with the lateral force supplied by the extension of the auger into the drain. The rotational force may be applied by human energy or by mechanical means. The primary class of devices utilized by professional plumbers includes a motorized drive to rotate the auger rapidly and with more force than can be exerted by hand.

With the advent of motorized augers, together with an auger containment receptacle, the strength and weight of augers has increased. More force and more resilience allows for quicker and easier rupture of even large collections of debris within drains and the like. Increasing weight and resiliency, however, has also increased the difficulty of inserting the auger into the drain. As the auger is increasingly inserted and the bulk of the auger is in the drain, its weight and length create a high level of friction with the surface of the drain pipe or conduit. This is increased considerably by bends and curves in the drain as well. The motorized units have also increased in bulk and power. These units are generally divided into hand held, drill-type units and floorstanding models.

In operation, the auger is inserted into the drain and the motor is engaged either during or alternatively with such insertion to rotate the auger within the drain. Handheld and floorstanding models are each adapted for utilization by a single operator, with floor models having foot switches to allow for remote operation of the motor while applying manual force to the auger. With the increasing bulk of augers, and for more efficient translation of lateral force to the auger, an additional mechanical advance has been added to the units, mostly to floorstanding units. This device provides a clamp which is typically affixed to the housing of the motor and engages the auger with a series of either threaded or pinch rollers which are angled to advance the auger laterally as a component of its rotational movement. This allows for utilization of the motor to create both rotational and lateral force and reducing the manual effort required to insert and rotate the auger.

More recently, remote power feed actuators have been introduced, as generally illustrated with respect to FIG. 1. These actuators are mounted remotely from the motor mechanism, typically at the downstream end of a conduit containing the auger. While these actuators may be applied to either the hand held or floorstanding models of drain cleaners, they are more typically applied to the floorstanding models. This allows the heavy floorstanding motor and auger containment receptacle to remain on the floor at a remote location from the entrance to the drain. A flexible conduit or guide tube containing the auger extends from the motor and auger container to the power feed actuator at the downstream end. The auger is inserted into the drain and the power feed actuator is engaged at the end of the guide tube proximate to the drain opening. In this fashion, a sole operator can observe and direct the auger and control its forward and rotational progress without leaving the drain opening, and without the bulk of the floorstanding motor and auger container being immediately underfoot.

One significant shortcoming of this arrangement, however, is that the auger tends to bind within the guide tube, especially as it meets resistance from the frictional interaction with the pipe and any debris within the pipe. As shown in FIG. 1, a drain cleaner 10 is provided with motorized auger control 15, which is depicted as the hand held embodiment. It is specifically noted that one skilled in the art would be able to interchange a floorstanding motorized auger control with the hand held unit depicted in FIG. 1. A guide tube 20 extends from the motorized auger control 15 to a remote power feed 25. The auger 30 is disposed within guide tube 20 and extends from motorized auger control 15 through remote power feed 25 and is adapted for insertion into a drain. An auger blade 35 or other cutting tool may be affixed to the downstream end of auger 30 to assist in the displacement of debris within the drain pipe. Auger is typically comprised of a helically wound outer sheath, but in any embodiment comprises a tough, durable outer housing which is adapted to resist axial compression. Consequently, when the resistance caused by friction between the auger 30 and the inner surface of guide tube 20 increases, the auger 30 tends to bind and curl into a helical shape which retards both its rotational and lateral movement. This is especially the case when the auger 30 meets resistance within the drain pipe or when a high degree of pressure is exerted on the auger 30 by remote power feed 25.

What is lacking in the art, therefore, is a motorized drain cleaning apparatus which permits the utilization of the remote power feed while negating the effects of its resistance upon the auger.

SUMMARY OF THE INVENTION

A drain cleaning apparatus is disclosed which comprises an auger for insertion into a drain pipe or conduit which is adapted to rupture or dislodge debris therein. The drain cleaning apparatus incorporates a motorized drive for causing rotational motion of the auger, which motorized drive is associated with a receptacle for the storage and distribution of the auger therefrom. The motorized drive may be of either a hand held or floorstanding type. A remote power feed device is affixed to the motorized drive by a guide tube in which the auger is extended. The remote power feed selectively engages the external surface of the auger and is adapted to translate the rotational movement of the auger caused by the motorized drive into lateral movement through the interaction of angularly mounted or threaded engagement means. The auger passes through the remote power feed and into the drain pipe. A guide conduit is rotatably mounted within the guide tube, encircling the auger therein. The guide conduit is mounted to the rotatable auger containment receptacle and the motorized drive, but is freely rotatably displaced within the guide tube. The guide conduit is adapted to rotate in a synchronous fashion with the motorized drive, the rotatable auger containment receptacle and the auger itself. The guide conduit is further adapted to provide a reduction in the frictional interface between the auger and the inner surface of the guide tube. It terminates within the guide tube proximate to the remote power feed. The guide conduit may be constructed of any flexible material which is adapted to resist compression in the lateral or axial direction. It may be constructed of a flexible plastic tube, or, most preferably, a spring.

In operation, the auger of the drain cleaning device is housed in the auger containment receptacle which is typically a circular spool mounted axially on and perpendicular to the drive shaft of the motorized drive. The auger is extended outwardly from the receptacle at the center of rotation of the receptacle and drive and extends along the axis formed by the center of rotation. A guide tube is mounted to accept the auger from the receptacle and extend for some length to terminate at a remote power feed mechanism. The auger is surrounded in the guide tube by the guide conduit. The guide conduit is securely mounted to the receptacle and rotates synchronously therewith, allowing the auger, guide conduit, receptacle and motor to rotate as a single unit. When the remote power feed mechanism is engaged, the force of the remote power feed engagement means causes the rotational movement of the auger to be translated into lateral movement in a spiral manner. To the extent that the auger resists the force exerted thereon and causes a curl or helix to form in its length within the guide tube, the auger exerts its helical force against the inner surface of the guide conduit, as opposed to the guide tube as known in the prior art. The guide conduit is adapted to rotate freely within the guide tube, allowing the motorized drive to continue without binding or unacceptable friction, while preventing the auger from binding within its core against lateral movement. The preferred spring embodiment is particularly well adapted for this application because of the reduced surface area of contact between the auger and the coils of the spring guide conduit.

These and other advantages and features of the present invention will be more fully understood with reference to the presently preferred embodiments thereof and to the appended drawings.

DESCRIPTION OF THE PREFERRED EMBODIMENTS

Figure 2:
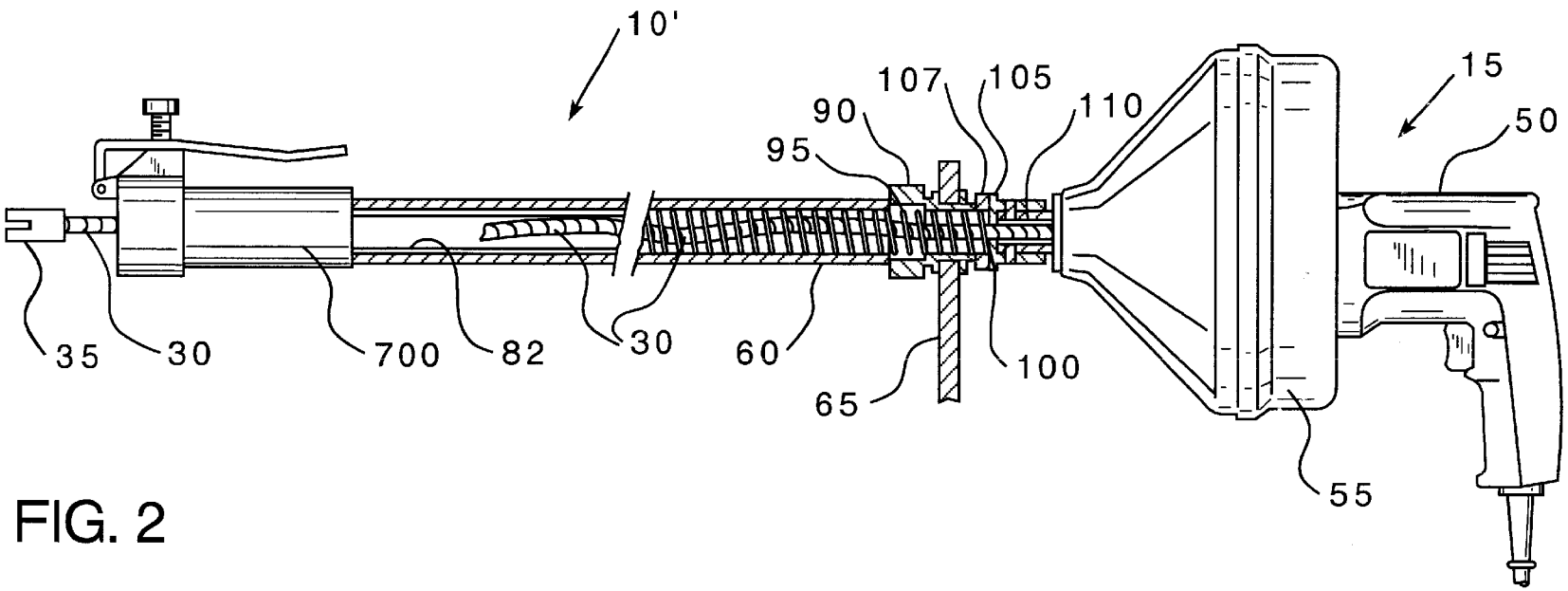
FIG. 2 is a side elevational view, partially in section, of a drain cleaning apparatus as described and claimed herein, including a first embodiment of the mounting of the guide conduit to the auger receptacle.

Referring now to FIG. 2, an improved drain cleaner 10' is provided with a motorized auger control 15. Motorized auger control 15 is preferably comprised of a motor 50, which may be of either the hand held variety or of the floorstanding variety. It is specifically contemplated that one skilled in the art will find these two embodiments interchangeable. The motorized auger control 15 is further comprised of an auger containment receptacle 55. Receptacle 55 is a hollow drum having a spool contained therein for the storage of the auger 30. The drum is mounted with its center axis aligned with the central axis of rotation of the motor of motorized auger control 15. The auger 30 is wound within receptacle 55 and exits from a point at the central axis of rotation and extends outwardly therealong. As will be described below, a guide tube 60 is mounted proximate to the receptacle 55 at the point where the auger 30 exits therefrom. The auger 30 is rotatably mounted within the guide tube 60 and extends along its entire length. A remote power feed 700 is mounted at the downstream end of guide tube 60, and is hollow to permit the passage of auger 30 therethrough. As will be described in more detail below with reference to FIG. 3, remote power feed selectively engages the outer surface of auger 30 in order to translate the rotational motion of the auger 30, imparted by motorized auger control 15, into lateral movement through the use of canted or threaded rollers which drive the auger 30 forwardly and outwardly therefrom.

The auger 30 is rotated by the rotation of the receptacle 55 which turns that portion of auger 30 which remains in the receptacle. The auger 30 is further supported by auger retention sheath 110 which extends outwardly from receptacle 55 within rotatable guide support 105. Each supports the auger 30 and rotates synchronously therewith. A flange support 90 is non-rotatably mounted within a support housing 65 which provides structural support for the mechanism. In the floorstanding embodiment, support housing 65 may be incorporated in an external housing supporting both motor 50 and receptacle 55. A guide conduit extends from rotatable guide support 105 to a point proximate to remote power feed 700. There is no particular endpoint of the guide conduit, but it should not frictionally engage the remote power feed 700. The guide conduit may be constructed of any flexible, hollow member, but is preferably constructed of flexible guide tubing 82 or, most preferably, guide spring 95. While all references which follow will be to guide spring 95, it is specifically intended that each of flexible guide tubing 82 and guide spring 95 shall be interchangeable with the other in all respects and that each be considered an alternative embodiment of the guide conduit.

Figure 1:
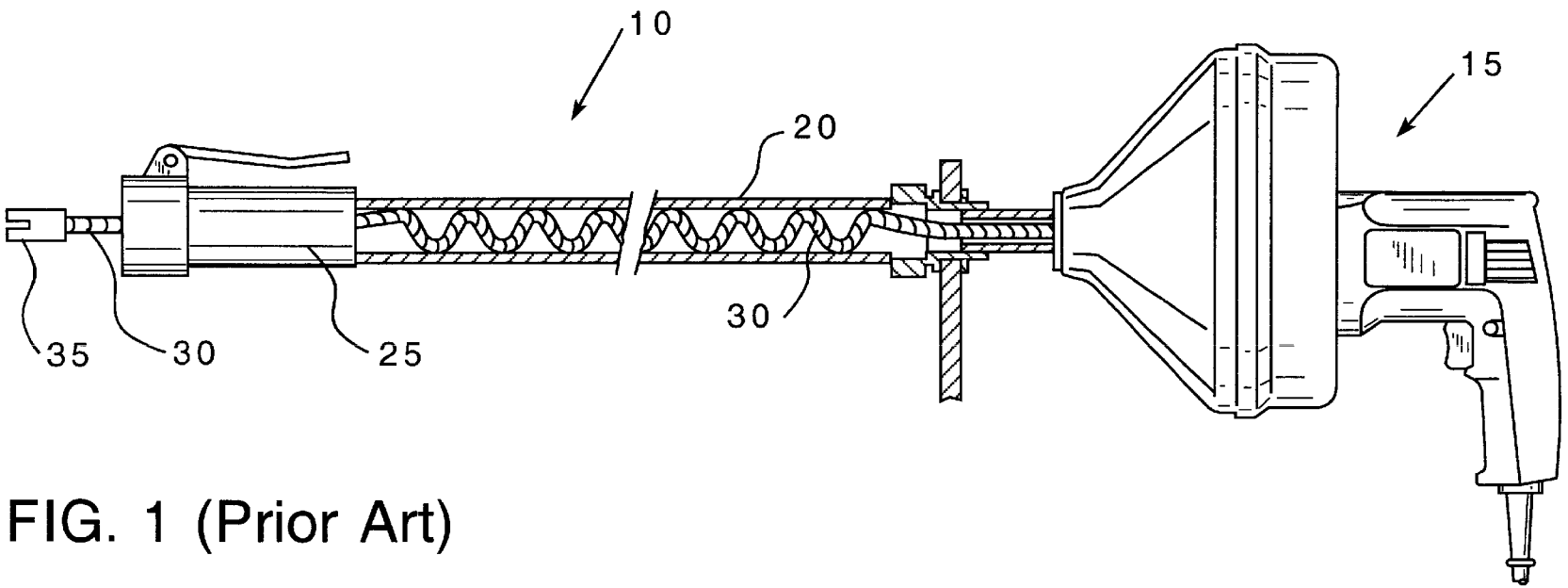
FIG. 1 (Prior Art)
FIG. 1 is a side elevational view, partially in section, of a drain cleaning apparatus of the prior art.

Guide spring 95 is mounted at its upstream end proximate to the exit point of auger 30 from receptacle 55. The guide spring 95 is hollow and is adapted to allow the free rotational and lateral displacement of auger 30 therein. Guide spring 95 is mounted to guide spring retainer and the facing surface of rotatable guide support 105. In FIG. 1, a first embodiment of the mounting and attachment is provided as tack weld 100 between guide spring 95 and rotatable guide support 105. Guide spring retainer 107 may be threadably engaged with rotatable guide support 105 or welded thereto.

In operation, motorized auger control 50 is engaged and rotates receptacle 55 which contains auger 30. Auger 30 extends from within receptacle 55 through auger retention sheath 110, through rotatable guide support 105 and into the central core of guide spring 95. Auger 30 extends along the length of guide spring 95 and through remote power feed 700 for insertion into the drain pipe. Rotatable guide support 105, auger retention sheath 110 and guide spring 95 rotate synchronously with auger 30, while housing 65, flange support 90, guide tube 60 and remote power feed 700 remain fixed with respect thereto. Guide spring 95 is specifically adapted to permit free rotation of guide spring 95 and auger 30 within guide tube 60 while allowing free lateral movement of auger 30 therein. While there are no particular characteristics of guide spring 95 to be specified, it is required that the spring be flexible enough to permit flexion of the combination of guide tube 60, guide spring 95 and auger 30. Furthermore, the coil angle of guide spring 95 is directly proportional to the gauge of the spring and the diameter of the coils.

Figure 3B:
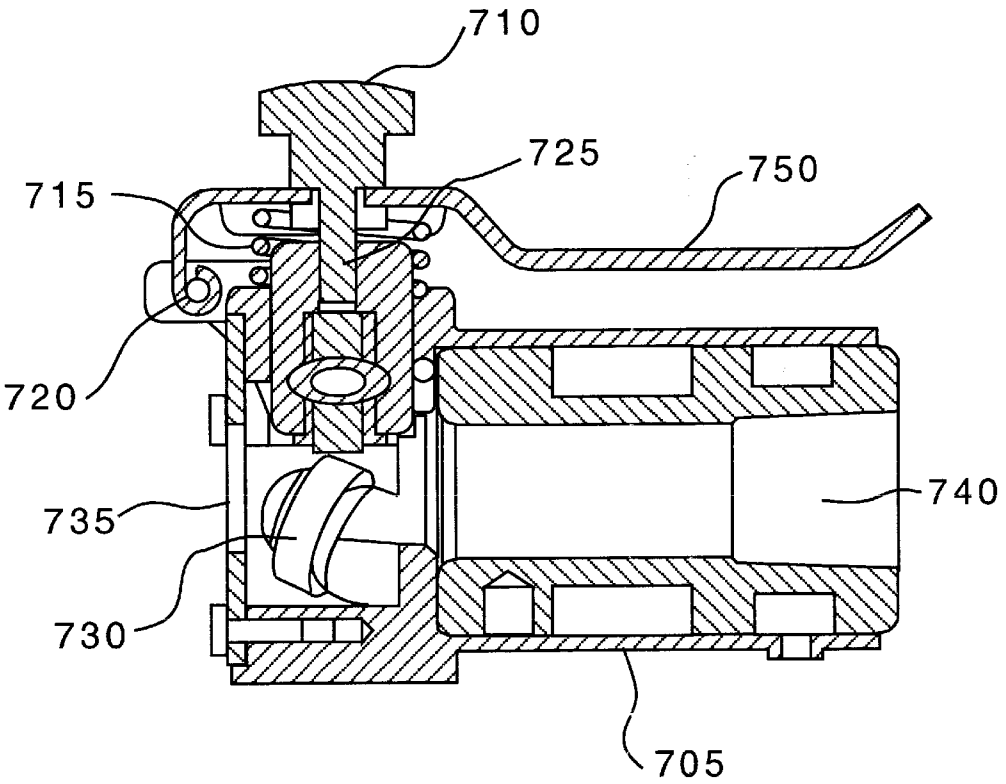
FIG. 3B is a side sectional view of the power feed mechanism of FIG. 3A, taken along line IIIB—IIIB.
Figure 3A:
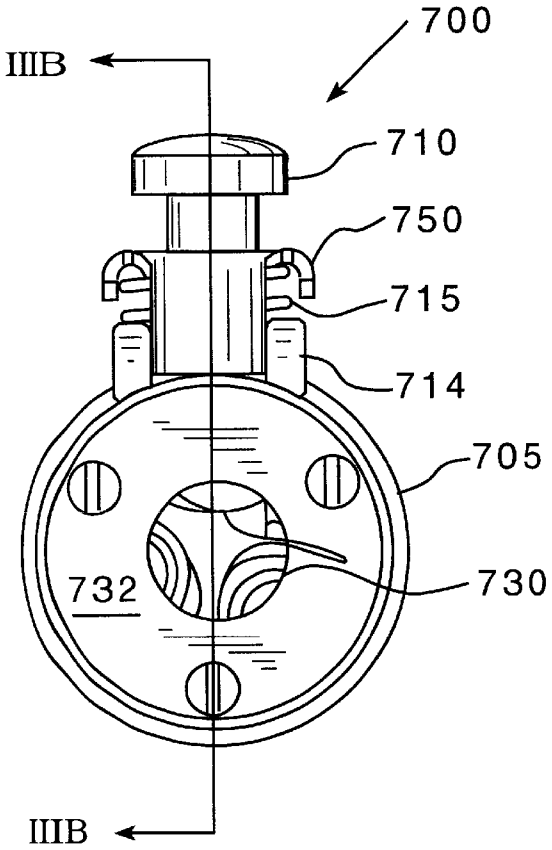
FIG. 3A is an end view of the power feed mechanism.

Referring now to FIG. 3, an adjustable power feed mechanism 700 is shown having a power feed housing 705 which is generally hollow. An adjustable power feed actuator 750 is pivotably mounted by power feed actuator mounting bracket 720 to actuator support boss 714. The actuator mechanism comprises power feed guide rollers 730 which selectively engage the exterior surface of auger 30. The rollers 730 are canted such that their rolling surfaces are diagonal to both the lateral and rotational components of the motion of auger 30. Auger 30 enters power feed chamber 740 and extends therethrough, passing through power feed port 735 in cover plate 732. Cover plate 732 is adapted to reduce the amount of debris which enters power feed mechanism 700. As auger 30 rotates and rollers 730 are selectively engaged in contact therewith, the rotational motion is translated into a lateral or axial and rotational component and the auger 30 is driven forward while spinning by the rollers 730 in a spiral fashion. Adjustable power feed actuator 750 is biased into a non-engaged position by adjustment spring 715 and the operator urges the actuator 750 against the spring 715 to force the engagement of rollers 730 against auger 30. In this manner, the rollers 730 are only engaged and auger 30 only moves laterally forward in the event that operator intervention is engaged. An override system is provided to allow continuous engagement of rollers 730 against auger 30 to assist the operator for long periods of engagement. Adjustment knob 710 is threadably engaged with adjustment shaft 725 and when actuator 750 is engaged, adjustment knob 710 may be displaced along shaft 725 to restrain actuator 750 in an engaged position for so long as adjustment knob 710 remains so displaced.

Figure 4:
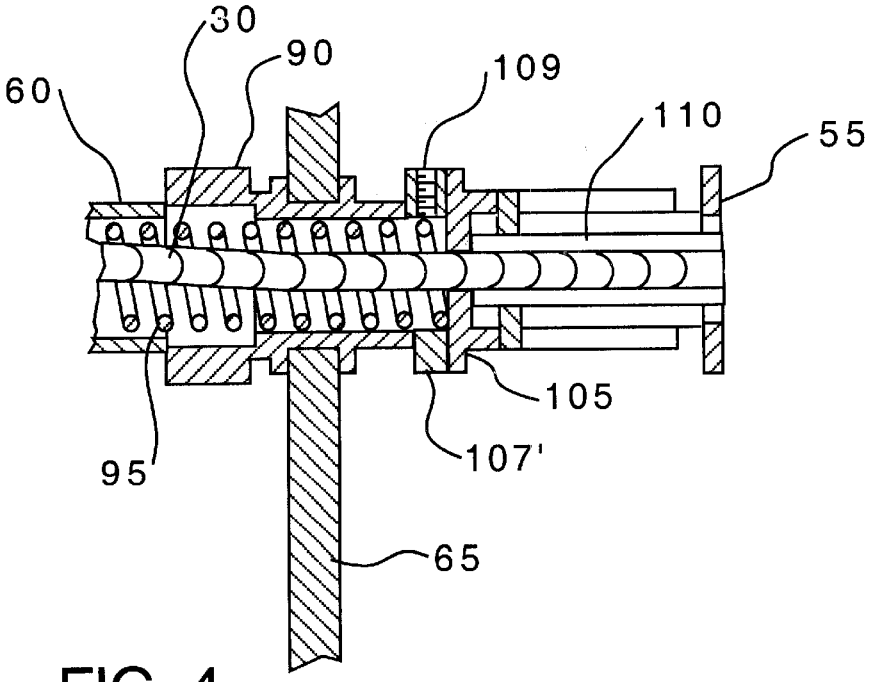
FIG. 4 is a side sectional view of a second embodiment of the mounting of the guide conduit to the auger receptacle.

Referring now to FIG. 4, an alternative second embodiment is illustrated for affixing the guide spring 95 to the rotatable receptacle 55. In this embodiment, guide spring retainer 107' is rotatably mounted adjacent flange support 90 in any manner known in the art. Guide spring retainer 107' is also mounted adjacent rotatable guide support 105 and affixed thereto such that both rotate synchronously. Guide spring retention screw 109 is threadably inserted within a receptacle within guide spring retainer 107' and is adapted to engage and restrain guide spring 95 within guide spring retainer 107' and adjacent to rotatable guide support 105 such that guide spring 95 rotates synchronously with rotatable guide support 105 and auger 30 which extends therethrough. Flange support 90, guide tube 60 and support housing 65 remain fixed relative thereto.

Figure 5:
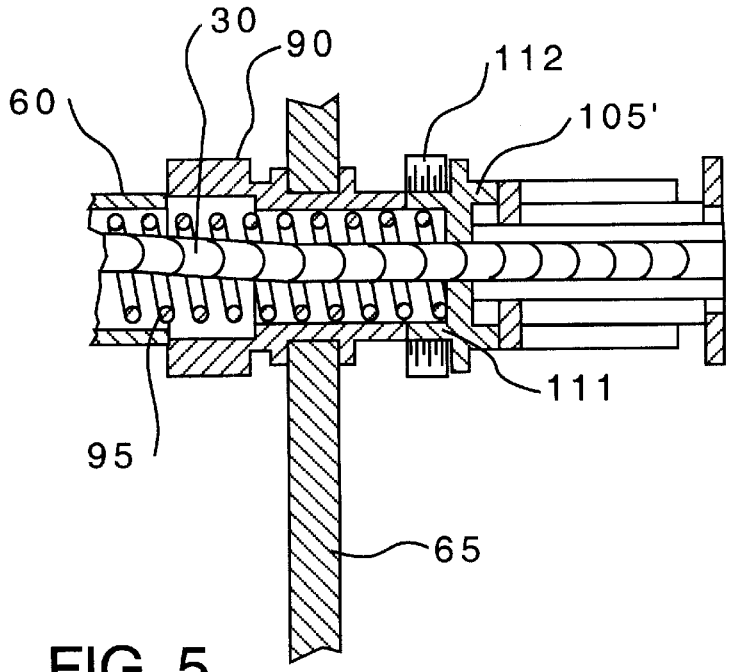
FIG. 5 is a side sectional view of a third embodiment of the mounting of the guide conduit to the auger receptacle.

Referring now to FIG. 5, an alternative third embodiment is illustrated for affixing the guide spring 95 to the rotatable receptacle 55. In this embodiment, rotatable guide support 105' is provided with a circular guide spring retention collar 111 mounted on the surface facing guide tube 60. Guide spring retention collar 111 is provided with slots (not shown) such that the collar is slightly resilient and can be selectively urged inwardly against guide spring 95 which is mounted circumferentially adjacent thereto. Guide spring retention locknut 112 is threadably engaged to the outer surface of guide spring retention collar 111 such that increasing threadable engagement of said guide spring retention locknut 112 about guide spring retention collar 111 decreases the diameter thereof and increases circumferential pressure on the external surface of guide spring 95, retaining it in place, such that both guide spring retention collar 111 and guide spring 95 rotate synchronously with auger 30 which extends therethrough. Flange support 90 and support housing 65 remain fixed relative thereto.

Figure 6:
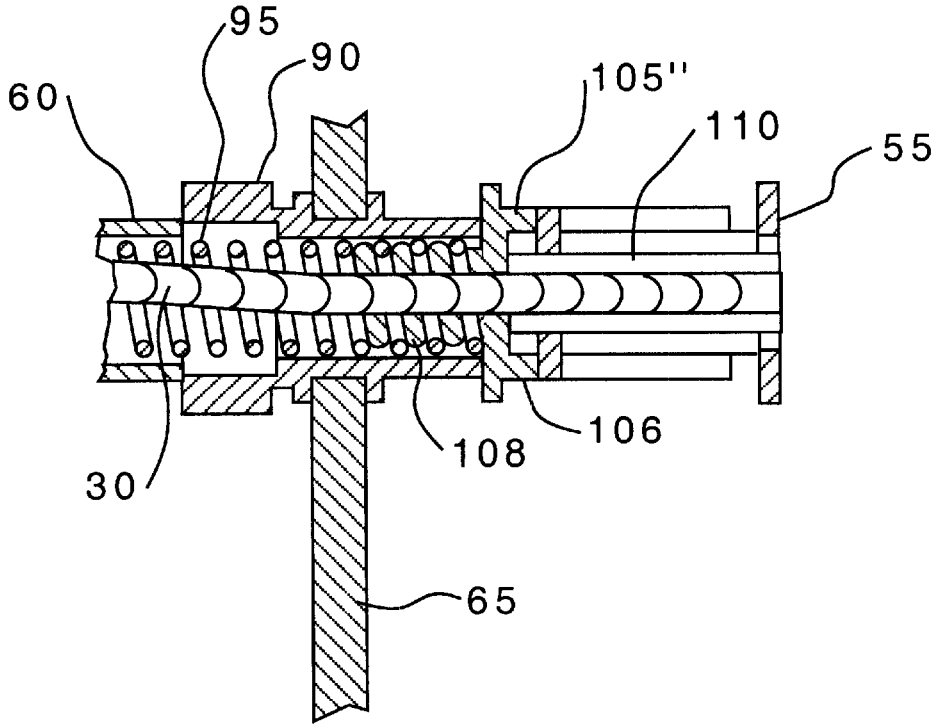
FIG. 6 is a side sectional view of a fourth embodiment of the mounting of the guide conduit to the auger receptacle.

Referring now to FIG. 6, an alternative fourth embodiment is illustrated for affixing the guide spring 95 to the rotatable receptacle 55. In this embodiment, rotatable guide support 105" is provided with an integral guide spring mount 108 extending outwardly therefrom within flange support 90. Guide spring mount 108 is provided with a threaded outer surface having depressions therein corresponding generally to the coils of guide spring 95, but slightly larger in diameter. This thread arrangement permits the threadable engagement of guide spring 95 and guide spring mount 108, while the slight difference in diameter therebetween creates an inward force of guide spring 95 on guide spring mount 108 sufficient to affix the same such that guide spring 95 rotates synchronously with rotatable guide support 105" and auger 30 which extends therethrough. Flange support 90 and support housing 65 remain fixed relative thereto. It should be specifically noted that guide spring 95 and guide spring mount 108 must be threaded such that the ordinary rotation thereof tends to tighten the guide spring 95 on guide spring mount 108.

The terms and expressions which have been employed here are used as terms of description and not as limitation, and there is no intention in the use of such terms and expressions of excluding equivalents of the features shown and described or portion thereof, it being recognized that various modifications are possible within the scope of the invention claimed.

Although particular embodiments of the present invention have been illustrated in the accompanying drawings and described in the foregoing detailed description, it is to be further understood that the present invention is not to be limited to just the embodiments disclosed, but that they are capable of numerous rearrangements, modifications and substitutions within the scope of the following claims.

What is claimed is:

1. A drain cleaning apparatus, comprising:

a motor adapted for rotational motion;

a receptacle mounted in conjunction with said motor adapted for rotational motion in conjunction with said motor, an auger adapted for storage within said receptacle and extendable outwardly therefrom, said auger being rotatably displaced synchronously with said receptacle and said motor;

a feed mechanism for selectively engaging said auger and selectively translating rotational motion of said auger at least partially into lateral motion of said auger;

a flexible hollow guide tube extending from said receptacle and fixedly mounted to said feed mechanism adapted to receive and encompass said auger; and a flexible guide conduit interposed between said auger and said guide tube, said guide conduit being fixedly mounted to said receptacle and adapted to rotate synchronously with said receptacle and said auger;

wherein said flexible hollow guide tube and said flexible guide conduit are constructed with sufficient resilience and flexibility to allow bending such that the feed mechanism can be directed at said drain.

2. A drain cleaning apparatus as described in claim 1, wherein said motor further comprises a hand held housing.

3. A drain cleaning apparatus as described in claim 1, wherein said guide tube has an upstream end and a downstream end and said feed mechanism is mounted to said downstream end.

4. A drain cleaning apparatus as described in claim 3, further comprising support means mounted to said upstream end of said guide tube.

5. A drain cleaning apparatus as described in claim 1, wherein said feed mechanism further comprises an actuator handle for selectively engaging said feed mechanism against said auger.

6. A drain cleaning apparatus as described in claim 1, wherein said feed mechanism further comprises guide means for translating rotational motion of said auger at least partially into lateral motion of said auger.

7. A drain cleaning apparatus as described in claim 6, wherein said guide means are rollers.

8. A drain cleaning apparatus as described in claim 7, wherein said guide rollers are canted with respect to the lateral axis of said auger.

9. A drain cleaning apparatus as described in claim 6, wherein said guide means are biased in a non-engaged mode with respect to said auger.

10. A drain cleaning apparatus as described in claim 9, wherein said guide means may be restrained in an engaged mode with respect to said auger.

11. A drain cleaning apparatus as described in claim 1, wherein said guide conduit further comprises a section of flexible tubing.

12. A drain cleaning apparatus as described in claim 1, wherein said guide conduit is rotatably affixed to said receptacle by a weld.

13. A drain cleaning apparatus as described in claim 1, further comprising a rotatable guide support rotatably affixed to said receptacle.

14. A drain cleaning apparatus as described in claim 13, wherein said rotatable guide support further comprises a guide conduit retainer for rotatably receiving and restraining said guide conduit.

15. A drain cleaning apparatus, comprising:

a motor adapted for rotational motion;

a receptacle mounted in conjunction with said motor adapted for rotational motion in conjunction with said motor;

an auger adapted for storage within said receptacle and extendable outwardly therefrom, said auger being rotatably displaced synchronously with said receptacle and said motor, a feed mechanism for selectively engaging said auger and selectively translating rotational motion of said auger at least partially into lateral motion of said auger;

a hollow guide tube extending from said receptacle and fixedly mounted to said feed mechanism adapted to receive and encompass said auger; and a guide conduit interposed between said auger and said guide tube, said guide conduit being fixedly mounted to said receptacle and adapted to rotate synchronously with said receptacle and said auger;

wherein said guide conduit further comprises a spring.

16. A drain cleaning apparatus as described in claim 15, further comprising a rotatable guide support rotatably affixed to said receptacle, wherein said rotatable guide support further comprises a guide conduit retainer for rotatably receiving and restraining said guide conduit and said guide conduit retainer farther comprises a looking collar having a retention screw threadably engaged therein, wherein said retention screw is selectively engaged to said guide conduit to rotatably restrain said guide conduit within said locking collar.

17. A drain cleaning apparatus as described in claim 12, further comprising a rotatable guide support rotatably affixed to said receptacle, wherein said rotatable guide support further comprises a guide conduit retainer for rotatably receiving and restraining said guide conduit and said guide conduit retainer further comprises a locking collar having a locking nut threadably engaged exterior thereto, wherein said locking nut is selectively engaged with said locking collar to urge and compress said locking collar into circumferential engagement with said guide conduit to rotatably restrain said guide conduit within said locking collar.

18. A drain cleaning apparatus as described in claim 15, further comprising a rotatable guide support rotatably affixed to said receptacle, wherein said rotatable guide support further comprises a guide conduit retainer for rotatably receiving and restraining said guide conduit and said guide conduit is comprised of a spring having coils, and said guide conduit retainer further comprises a threaded mount constructed integrally with said rotatable guide support and mounted within said guide tube and said spring, wherein the threads of said threaded mount threadably engage the coils of said spring to rotatably restrain said guide conduit to said rotatable guide support.

19. A drain cleaning apparatus as described in claim 18, wherein said threaded mount and said threads thereof are sized such that said coils of said spring are extended sufficiently to restrain said spring on said threaded mount during the synchronous rotation thereof.

20. In a drain cleaning apparatus of the type having a motor, a receptacle mounted in conjunction with said motor, an auger adapted for storage within said receptacle and extendable outwardly therefrom, a feed mechanism for selectively engaging said auger, and a flexible hollow guide tube extending from said receptacle and fixedly mounted to said feed mechanism adapted to receive and encompass said auger, wherein the improvement comprises a flexible guide conduit constructed with sufficient resilience and flexibility to allow bending interposed between said auger and said flexible guide tube such that the feed mechanism can be directed at said drain, said flexible guide conduit being fixedly mounted to said receptacle and adapted to rotate synchronously with said receptacle and said auger.

* * * * *

UNITED STATES PATENT AND TRADEMARK OFFICE

CERTIFICATE OF CORRECTION

PATENT NO. : 6,470,525 B1
DATED : October 29, 2002
INVENTOR(S) : Arthur A. Silverman It is certified that error appears in the above-identified patent and that said Letters Patent is hereby corrected as shown below:

Column 2,
Line 32, after "Auger" insert -- 30 --.

Column 8,
Line 10, "farther" should be -- further --.
Line 10, "looking" should be -- locking --.
Line 15, "claim 12" should be -- claim 15 --.

Signed and Sealed this

First Day of April, 2003

JAMES E. ROGAN
*Director of the United States Patent and Trademark Office*